US011560285B2

(12) United States Patent
Egawa

(10) Patent No.: US 11,560,285 B2
(45) Date of Patent: Jan. 24, 2023

(54) SHEET STACKING DEVICE AND POST-PROCESSING APPARATUS

(71) Applicant: KYOCERA Document Solutions Inc., Osaka (JP)

(72) Inventor: Keisuke Egawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/352,905

(22) Filed: Jun. 21, 2021

(65) Prior Publication Data

US 2021/0403270 A1 Dec. 30, 2021

(30) Foreign Application Priority Data

Jun. 25, 2020 (JP) ..... JP2020-109351

(51) Int. Cl.
*B65H 31/36* (2006.01)
*B65H 31/18* (2006.01)
*B65H 31/10* (2006.01)

(52) U.S. Cl.
CPC ..... *B65H 31/36* (2013.01); *B65H 31/10* (2013.01); *B65H 31/18* (2013.01); *B65H 2301/4222* (2013.01); *B65H 2301/42261* (2013.01); *B65H 2404/1114* (2013.01); *B65H 2404/1532* (2013.01); *B65H 2404/267* (2013.01); *B65H 2405/1134* (2013.01); *B65H 2405/11151* (2013.01); *B65H 2601/521* (2013.01); *B65H 2801/06* (2013.01)

(58) Field of Classification Search
CPC ..... B65H 31/36; B65H 31/38; B65H 2301/4222; B65H 2404/1532; B65H 2404/267; B65H 31/10
USPC ..... 271/217
See application file for complete search history.

(56) References Cited

U.S. PATENT DOCUMENTS 10,274,886 B2 * 4/2019 Ko ..... B65H 31/18

FOREIGN PATENT DOCUMENTS

JP 2009-249110 A 10/2009
JP 2010111511 A * 5/2010 ..... B65H 31/10

* cited by examiner

*Primary Examiner* — Jeremy R Severson
(74) *Attorney, Agent, or Firm* — Studebaker & Brackett PC

(57) ABSTRACT

A sheet stacking device includes a discharge port, an alignment wall, a discharge tray, an alignment belt, and a guide part. The alignment wall extends in an upper-and-lower direction below the discharge port. The discharge tray is provided so as to be capable of moving up and down along the alignment wall. The alignment belt with endless is stretched along the alignment wall in the upper-and-lower direction. The alignment belt has an inner circumferential surface facing the alignment wall and an outer circumferential surface with which an upstream edge of the sheet stacked on the discharge tray comes into contact, and circulates at a same speed as the discharge tray in synchronization with the discharge tray. The guide part is configured to be provided between the alignment wall and the alignment belt. With the guide part, the inner circumferential surface of the alignment belt slides in contact.

7 Claims, 6 Drawing Sheets

SHEET STACKING DEVICE AND POST-PROCESSING APPARATUS

INCORPORATION BY REFERENCE

This application is based on and claims the benefit of priority from Japanese patent application No. 2020-109351 filed on Jun. 25, 2020, which is incorporated by reference in its entirety.

BACKGROUND

The present disclosure relates to a sheet stacking device including a discharge tray on which a sheet is stacked, and a post-processing apparatus.

In a post-processing apparatus, a discharge tray on which discharged sheets are stacked is supported in a posture inclined upward toward the downstream side in the discharge direction. By inclining the discharge tray in the above posture, the discharged sheet is slid on the upstream side along the discharge tray by its own weight, and the sheet can be aligned by bringing the trail edge (the upstream edge in the discharge direction) of the sheet contact with an upright wall. In some cases, an external force is applied to the sheet discharged on the discharge tray to return the sheet on the upstream side in the discharge direction.

In the case of the discharge tray capable of stacking a large amount (3000 to 4000 sheets) of the sheets, the discharge tray is lifted and lowered in accordance with a height of the stacked sheets. That is, since the height of a sheet discharge port is constant, when the height of the stacked sheets is increased, the discharge tray is lowered to maintain a constant distance between the uppermost sheet and the discharge port. When the discharge tray is lifted and lowered in this manner, there is a problem that the trail edges (the upstream edges in the discharge direction) of the stacked sheets are rubbed against the upright wall, and abnormal noise is generated or the trail edges of the sheets are scraped and damaged. In particular, when the external force is applied to the sheet, the load applied from the upright wall to the trail edge of the sheet becomes larger.

Then, a sheet discharge device is sometimes provided with a receiving member which projects outward (on the downstream side in the discharge direction) from a side wall (corresponding to the upright wall) and comes into contact with the trail edge of the sheet. The receiving member lifts and lowers together with the stacking tray (corresponding to the discharge tray).

However, in the sheet discharge device described above, since the load of the sheets stacked on the stacking tray is applied to the receiving member, the receiving member may be bent inward (on the upstream side in the discharging direction), and the sheets may not be accurately aligned.

SUMMARY

In accordance with an aspect of the present disclosure, a sheet stacking device includes a discharge port, an alignment wall, a discharge tray, an alignment belt, and a guide part. Through the discharge port, a sheet is discharged along a predetermined discharge direction. The alignment wall extends in an upper-and-lower direction below the discharge port. On the discharge tray, which the sheet discharged through the discharge port is stacked. The discharge tray is provided so as to be capable of moving up and down along the alignment wall. The alignment belt with endless is stretched along the alignment wall in the upper-and-lower direction. The alignment belt has an inner circumferential surface facing the alignment wall and an outer circumferential surface with which an upstream edge of the sheet stacked on the discharge tray in the discharge direction comes into contact, and circulates in the upper-and-lower direction at a same speed as the discharge tray in synchronization with the discharge tray. The guide part is configured to be provided between the alignment wall and the alignment belt. With the guide part, the inner circumferential surface of the alignment belt slides in contact.

In accordance with an aspect of the present disclosure, a post-processing apparatus includes the sheet stacking device in which the sheet on which a post-processing is performed is stacked on the sheet stacking device.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Hereinafter, with reference to the attached drawings, a post-processing apparatus and a sheet stacking device according to one embodiment of the present disclosure will be described.

Figure 1:
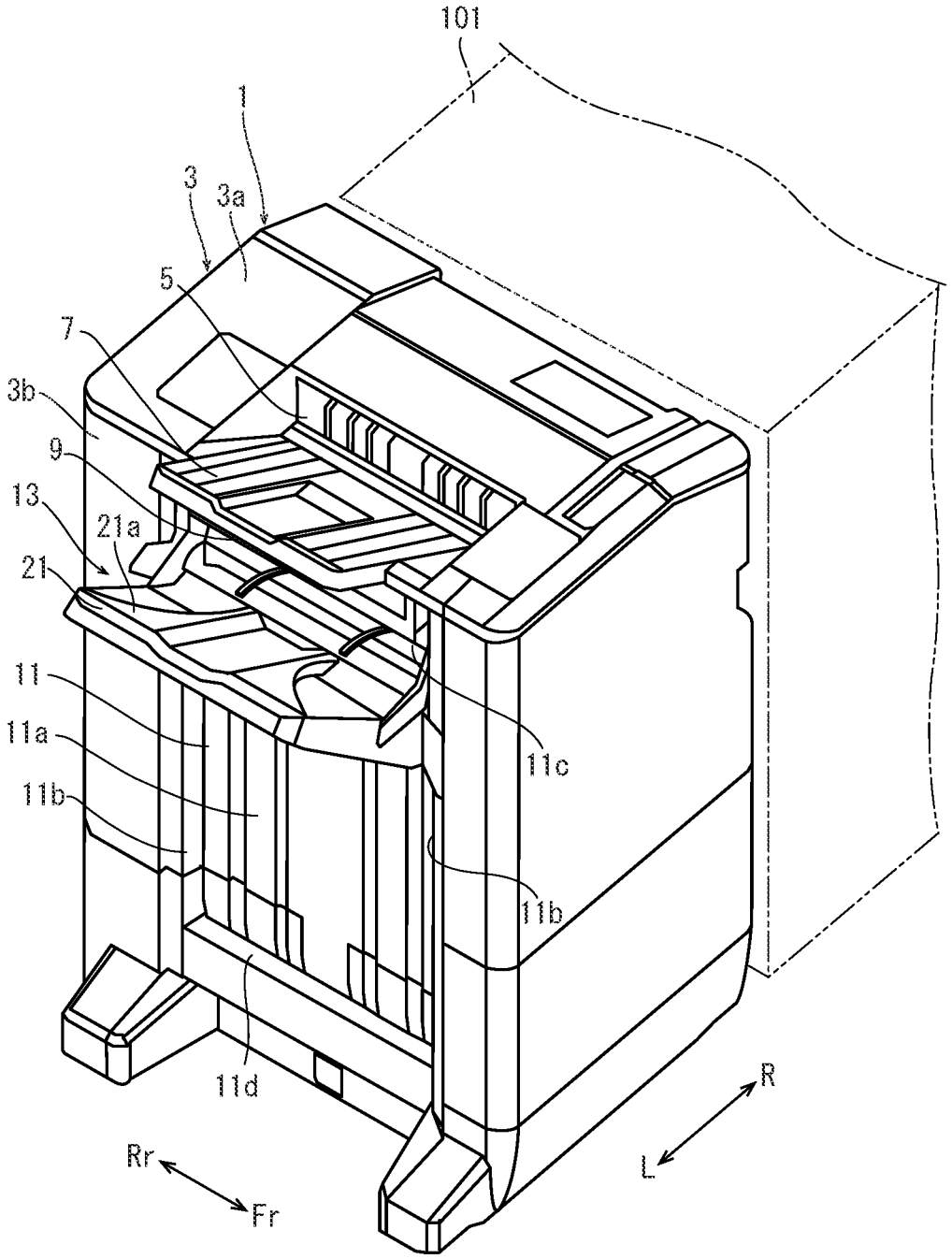
FIG. 1 is a perspective view showing a post-processing apparatus according to one embodiment of the present disclosure.

With reference to FIG. 1, an entire structure of a post-processing apparatus 1 including a sheet stacking device 13 will be described. Fr, Rr, L and R marked in each figure indicate a front side, a rear side, a left side and a right side of the post-processing apparatus 1, respectively. The post-processing apparats 1 is disposed adjacent to an image forming apparatus 101, for example, and preforms a post-processing on a sheet formed with an image by the image forming apparatus 101.

The post-processing apparatus 1 has a main body 3, and on one side plate (a right side plate) of the main body 3, a receiving port (not shown) for a sheet is formed. The receiving port is communicated with a dishrag port of the image forming apparatus 101. On the top plate 3*a* of the main body 3, an upper discharge port 5 and a fixed discharge tray 7 are formed. On the other side plate (a left side plate) of the main body 3, a lower discharge port 9 and a recess 11 are formed. The lower discharge port 9 is disposed in the upper portion of the other side plate. The recess 11 is formed along the upper-and-lower direction below the lower discharge port 9, and surrounded by a bottom wall 11*a* as an alignment wall, both side walls lib, an upper wall 11*c* and a lower wall 11*d*. In the recess 11, the sheet stacking device 13 is supported in a liftable and lowerable manner.

Inside the main body 3, a conveyance path (not shown) is formed, on which the sheet is conveyed along a substantial horizontal conveyance direction from the receiving port to the inside the main body 3. The conveyance path is branched into paths toward the upper discharge port 5 and the lower discharge port 9 at a branch point on a middle of the conveyance path. On a middle of the conveyance path, a punching unit or a staple unit (both are not shown) for performing various post-processing is provided. The sheet or the sheet stack is discharged through the upper discharge port 5 or the lower discharge port 9 after the post-processing is performed, and then staked on the fixed discharge tray 7 or the sheet stacking device 13. A direction in which the sheet is discharged through the lower discharge port 9 is defined as a discharge direction.

Figure 2:
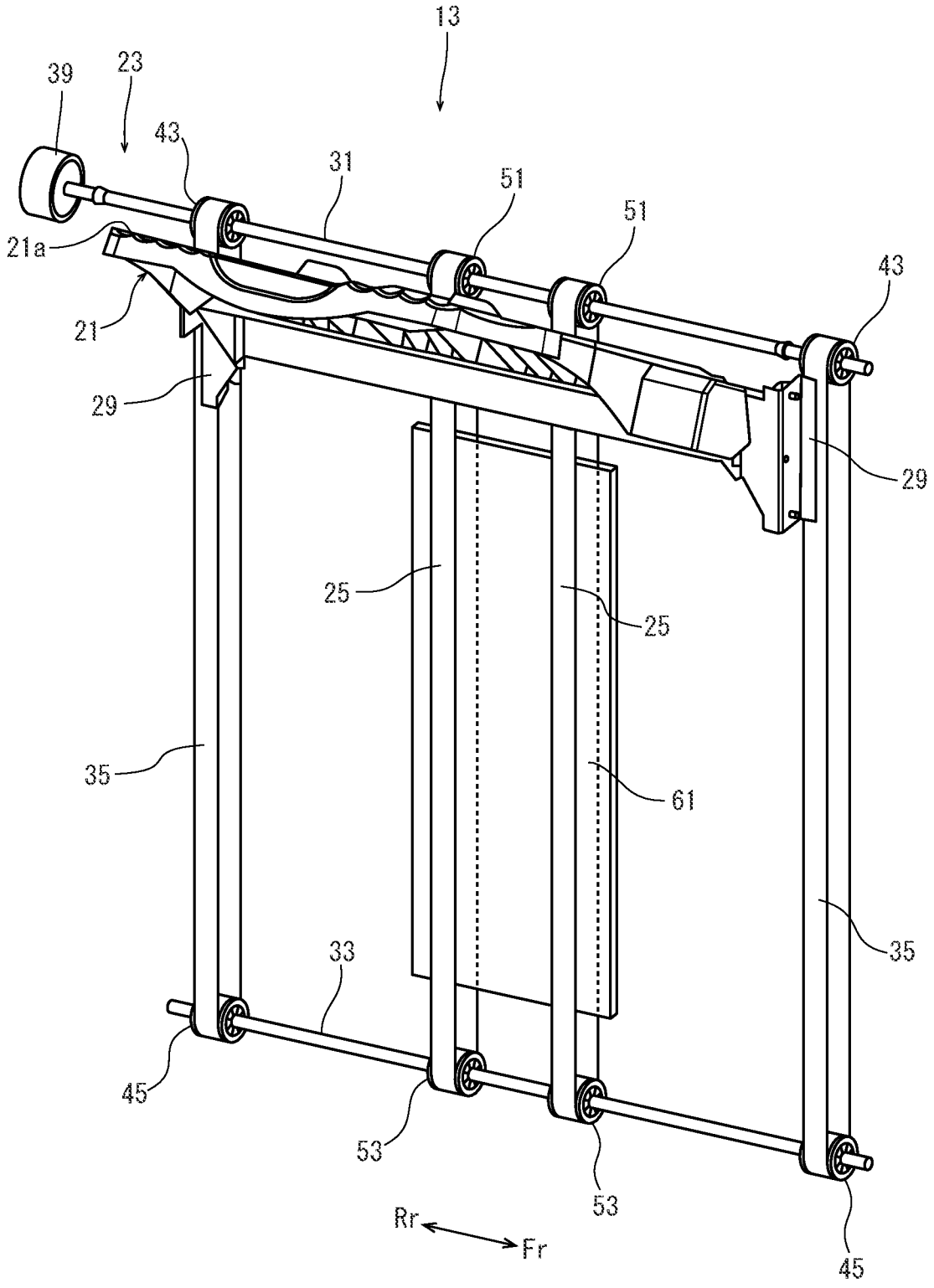
FIG. 2 is a perspective view showing a sheet stacking device according to the embodiment of the present disclosure.
Figure 3:
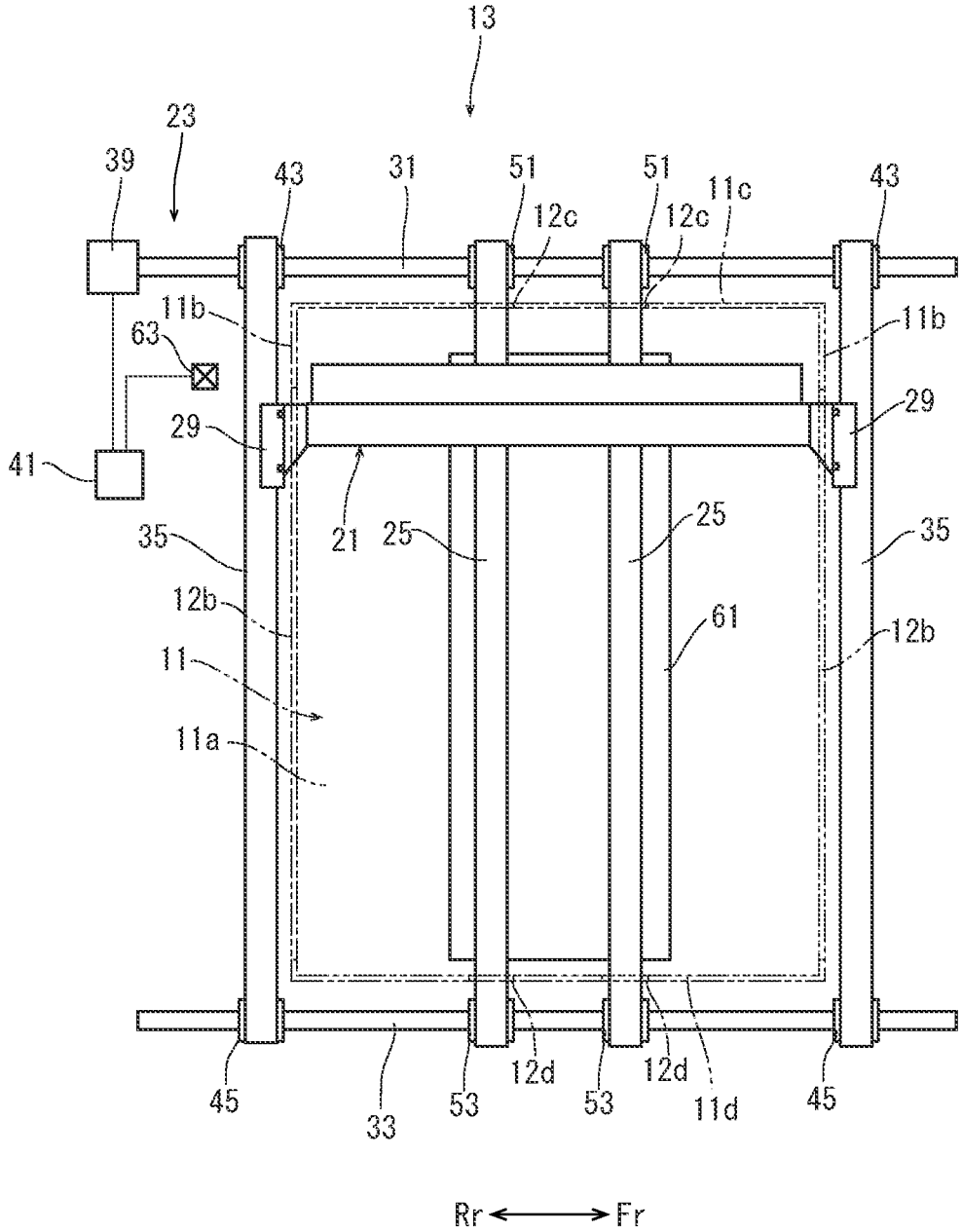
FIG. 3 is a front view showing the sheet stacking device according to one embodiment of the present disclosure.

Next, the sheet stacking device 13 will be described with reference to FIG. 1, and FIG. 2 to FIG. 4. FIG. 2 is a perspective view showing the sheet stacking device 13, FIG. 3 is a front view showing the sheet stacking device 13 and FIG. 3 is a sectional view showing the sheet stacking device 13.

The sheet stacking device 13 includes a discharge tray 21 on which the sheet discharged through the lower discharge port 9 (see FIG. 1) is stacked, an elevating part 23 configured to be able to move up and down the discharge tray 21, and two alignment belts 25.

The discharge tray 21 has a sheet stacking surface 21*a* inclined upward toward the downstream side in the discharge direction X (the left direction in FIG. 2). On the front and rear side faces of the discharge tray 21, front and rear brackets 29 are fixed. The bracket 29 is bent outward from the upstream end portion (the right portion in FIG. 2) in the discharge direction X.

The elevating part 23 includes a drive shaft 31, a driven shaft 33, and front and rear lifting belts 35 which are stretched between the drive shaft 31 and the driven shaft 33.

Figure 4:
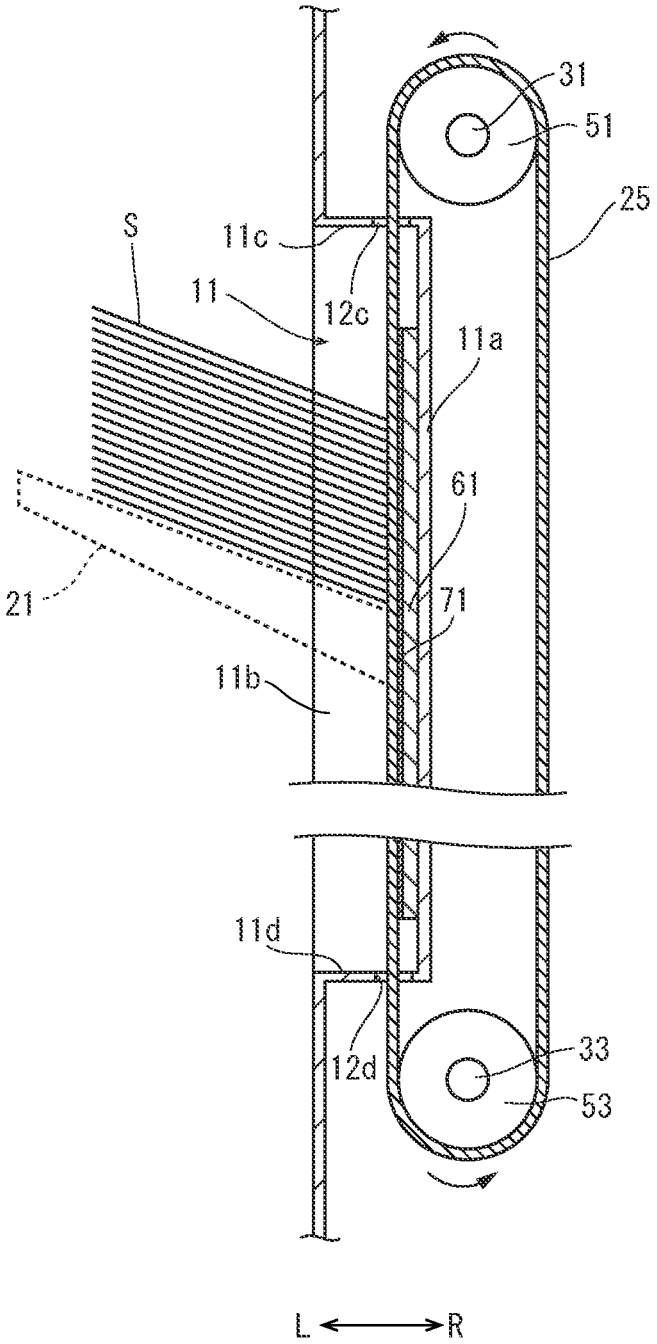
FIG. 4 is a side view showing the sheet stacking device according to the embodiment of the present disclosure.

As shown in FIG. 3 and FIG. 4, the drive shaft 31 is disposed above the recess 11 of the main body 3 along a width direction perpendicular to the discharge direction X, and both end portions of the drive shaft 31 are supported by the main body 3 in a rotatable manner. One end portion (the rear end portion) of the drive shaft 31 is connected to a drive motor 39. The drive motor 39 is controlled by a controller 41 to be driven. The driven shaft 33 is disposed below the recess 11 along the width direction, and both end portions of the driven shaft 33 are supported by the main body 3 in a rotatable manner.

The front and rear lifting belts 35 are each a toothed endless belt in which teeth are formed along the inner circumferential surface. The front and rear lifting belts 35 are disposed on the outer side and the inner side of the recess 11, and meshed with sprockets 43 fixed to the drive shaft 31 and sprockets 45 fixed to the driven shaft 33. When the drive shaft 31 is driven by the drive motor 39 to be rotated, the front and rear lifting belts 35 circulate in the same direction in synchronization with each other.

On the outer circumferential surfaces the front and rear lifting belts 35, the front and rear brackets 29 of the discharge tray 21 are fixed. The front and rear brackets 29 are fixed to the outer circumferential surfaces of the front and rear lifting belts 35 through openings 12*b* formed in the front and rear side walls 11*b* of the recess 11. When the front and rear lifting belts 35 circulate, the discharge tray 21 is moved up and down in the recess 11. The front and rear brackets 29 are moved along the openings 12*b*.

The two alignment belts 25 are each an endless belt having a predetermined width and having no teeth formed on the inner circumferential surface. The two alignment belts 25 are disposed in the center portion of the recess 11 at a predetermined interval in the front-and-rear direction, and are stretched between pulleys 51 fixed to the drive shaft 31 and pulleys 53 fixed to the driven shaft 33. The diameters of both pulleys 51, 53 are equal to the diameters of two sprockets 43, 45 of the lifting belts 35.

As shown in FIG. 4, the two alignment belts 25 pass through opening 12*c* formed in the upper wall 11*c* and opening 12*d* formed in the lower wall 11*d* of the recess 11, and are stretched between the drive shaft 31 and the driven shaft 33. That is, the two alignment belts 25 are disposed on the outside of the bottom wall 11*a* of the recess 11 (the left side, the downstream side in the discharge direction) and the inside of the bottom wall 11*a* of the recess 11 (the right side, the upstream side in the discharge direction). In the outside of the bottom wall 11*a*, a predetermined space is provided between the two alignment belts 25 and the bottom wall 11*a*. That is, the two alignment belts 25 are separated from the bottom wall 11*a* by a predetermined distance outward (the left side, the downstream side in the discharge direction). The alignment belts 25 may be attached to the pulleys in such a manner that notches are formed in the upper and lower walls 11*c* and 11*d* outside the openings 12*c* and 12*d*, the alignment belts 25*a* passes through the notches from the near side on the paper surface of FIG. 4, and then attached to the pulleys on both sides of the bottom wall 11*a*.

When the drive shaft 31 is driven by the drive motor 39 to be rotated, the two alignment belts 25 circulate in synchronization with the front and rear lifting belts 35. In other words, the two alignment belts 25 circulate at the same speed as the discharge tray 21 in synchronization with the discharge tray 21.

A guide plate 61 as a guide part is disposed between the inner circumferential surfaces of the two alignment belts 25 and the bottom wall 11*a*. The guide plate 61 is a flat plate-shaped member having a flat surface, and has a height equivalent to the lifting range of the discharge tray 21 and a width slightly longer than the distance between the two alignment belts 25. The guide plate 61 is fixed to the bottom wall 11*a* in a posture in which the flat surface faces the outside (the side of the two alignment belts 25). The outer surface of the guide plate 61 comes in contact with the inner circumferential surfaces of the two alignment belts 25, and the inner circumferential surfaces of the alignment belts 25 slide with respect to the outer surface of the guide plate 61 when the two alignment belts 25 circulate. The guide plate 61 may be fixed between the front and rear side walls 11*b* of the recess 11. Further, the guide part may be integrally formed on the bottom wall 11*a*, and the bottom wall 11*a* may have a function of the guide part.

Further, in the recess 11 of the main body 3, a height detection sensor 63 (see FIG. 3) for detecting a height of the sheets stacked on the sheet stacking surface 21*a* of the discharge tray 21 is provided.

The height detection sensor 63 is an optical sensor, and has a light emitting part and a light receiving part arranged so as to cross a space under the lower discharge port 9 at a predetermined height. The height detection sensor 63 outputs an OFF signal to the controller 41 when the light emitted from the light emitting part is received by the light receiving part, and outputs an ON signal to the controller 41 when the light emitted from the light emitting part is not received by the light receiving part. That is, when the height of the upper surface of the sheet or the sheet stack stacked on the sheet stacking surface 21*a* is lower than the predetermined height, the light emitted from the light emitting part is received by the light receiving part without being blocked by the sheet or the sheet stack, so that the height detection sensor 63 outputs the OFF signal to the controller 41. On the other hand, when the height of the upper surface of the sheet or he sheet stack stacked on the sheet stacking surface 21*a* is higher than the predetermined height, the light emitted from the light emitting part is blocked by the sheet or the sheet stack and is not received by the light receiving part, so that the height detection sensor 63 outputs the ON signal to the controller 41.

Figure 5A:
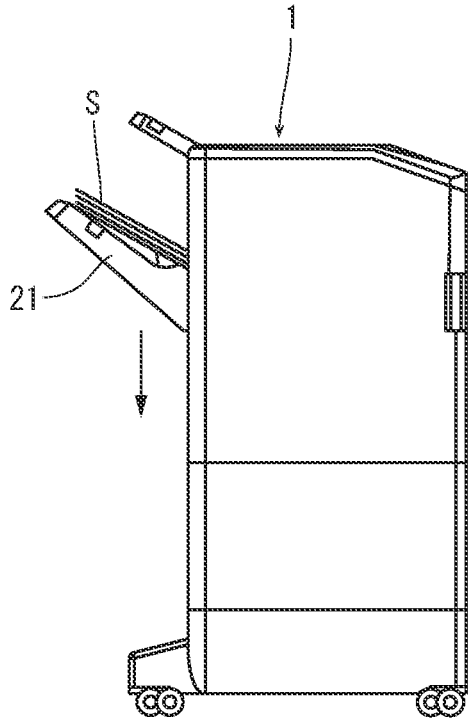
FIG. 5A is a side view showing a discharge tray in a case of low staking height, in the post-processing apparatus according to the embodiment of the present disclosure.
Figure 5B:
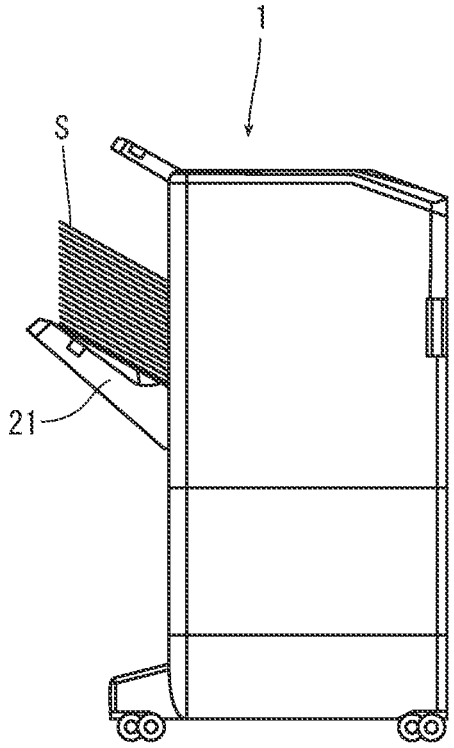
FIG. 5B is a side view showing the discharge tray in a case of high staking height, in the post-processing apparatus according to the embodiment of the present disclosure.

Next, a sheet discharge operation of the sheet stacking device 13 having the above configuration will be described with reference to FIG. 2 to FIG. 4, FIG. 5A, and FIG. 5B. FIG. 5A and FIG. 5B are front views showing the position of the discharge tray 21 according to the stacking height. In the initial state, the discharge tray 21 of the sheet stacking device 13 stands by at the highest position below the lower discharge port 9.

The sheet S discharged through the lower discharge port 9 is stacked on the sheet stacking surface 21*a* of the discharge tray 21 of the sheet stacking device 13. The stacked sheet S is shifted downward along the sheet stacking surface 21*a* in the inclined direction of the sheet stacking surface 21*a* (in the lower right direction, an oblique lower direction toward the upstream side in the discharge direction). Then, as shown in FIG. 4, the trail edge of the sheet S (the upstream edge in the discharge direction) comes into contact with the outer circumferential surfaces of the two alignment belts 25, and is aligned along the discharge direction. That is, since the outer circumferential surfaces of the two alignment belts 25 are separated from the bottom wall 11*a* of the recess 11 to the outside (on the downstream side in the discharge direction), the trail edge of the sheet S comes into contact with not the bottom wall 11*a* but the alignment belts 25.

The height of the sheets S stacked on the sheet stacking surface 21*a* is detected by the height detection sensor 63 (see FIG. 3). When the detected height becomes higher than the predetermined height, the light emitted from the light emitting part of the height detection sensor 63 is blocked by the sheets S and is not received by the light receiving part, and the height detection sensor 63 outputs the ON signal to the controller 41. Then, the controller 41 determines that the sheets S of the predetermined height are stacked on the sheet stacking surface 21*a*.

The controller 41 checks the output of the height detection sensor 63 each time when a fixed number of the sheets are discharged. When a predetermined number of the sheets are stacked on the sheet stacking surface 21*a*, the height of the upper surface of the stacked sheets S becomes higher than the predetermined height, and the output of the height detection sensor 63 is switched from the OFF signal to the ON signal. Then, the controller 41 controls the drive motor 39 to move down the discharge tray 21 until the height detection sensor 63 outputs the OFF signal (see FIG. 5A and FIG. 5B). After the discharge tray 21 is moved down and stopped, the discharge tray 21 is moved up until the height detection sensor 63 outputs the ON signal. While the sheet S is discharged, the controller 41 repeats the moving up and down operation of the discharge tray 21. Thus, when the number of the stacked sheets increases, the discharge tray 21 is moved down while maintaining the position (height) of the uppermost sheet stacked on the sheet stacking surface 21*a* at a predetermined height.

When the discharge tray 21 is moved down, the alignment belts 25 are also lowered together with the discharge tray 21 as described above. That is, the discharge tray 21 and the alignment belt 25 are lowered while the trail edges of the sheets S are kept in contact with the same position of the alignment belts 25. As described above, since the trail edges of the sheets S stacked on the discharge tray 21 does not slide with respect to the alignment belts 25, generation of abnormal noise and damage to the trail edge of the sheet S can be prevented. When the stacking height of the sheet S is increased, a load applied from the sheets S to the alignment belts 25 is increased. However, since the inner circumferential surfaces of the alignment belts 25 slide in contact with the guide plate 61 and is guided along the upper-and-lower direction, it becomes possible to make the alignment belts 25 circulate without bending.

As described above, according to the sheet stacking device 13 according to the present disclosure, even if the stacking height of the sheets becomes higher and a load applied to the alignment belts 25 from the sheets S is increased, the alignment belts 25 are guided in the upper-and-lower direction along the guide plate 61, so that it becomes possible to make the alignment belts 25 circulate without bending. Therefore, the alignment belts 25 are kept in a posture along the upper-and-lower direction, so that the sheets S can be aligned surely in the discharge direction by bringing the trail edge of the sheet into contact with the alignment belts 25.

Further, a slide sheet 71 having a slidability larger than the guide plate 61 (for example, ultra-high polymer polyethylene sheet) may be attached on the outer circumferential surface of the guide plate 61 (the surface facing the inner circumferential surfaces of the alignment belts 25). When the alignment belts 25 circulate at the moving up and down of the discharge tray 21, the alignment belts 25 slide with respect to the guide plate 61. Because the slide sheet 71 is attached on the guide plate 61 to reduce a friction between the alignment belts 25 and the guide plate 61, it becomes possible to make the alignment belt 25 circulate smoothly.

Figure 6:
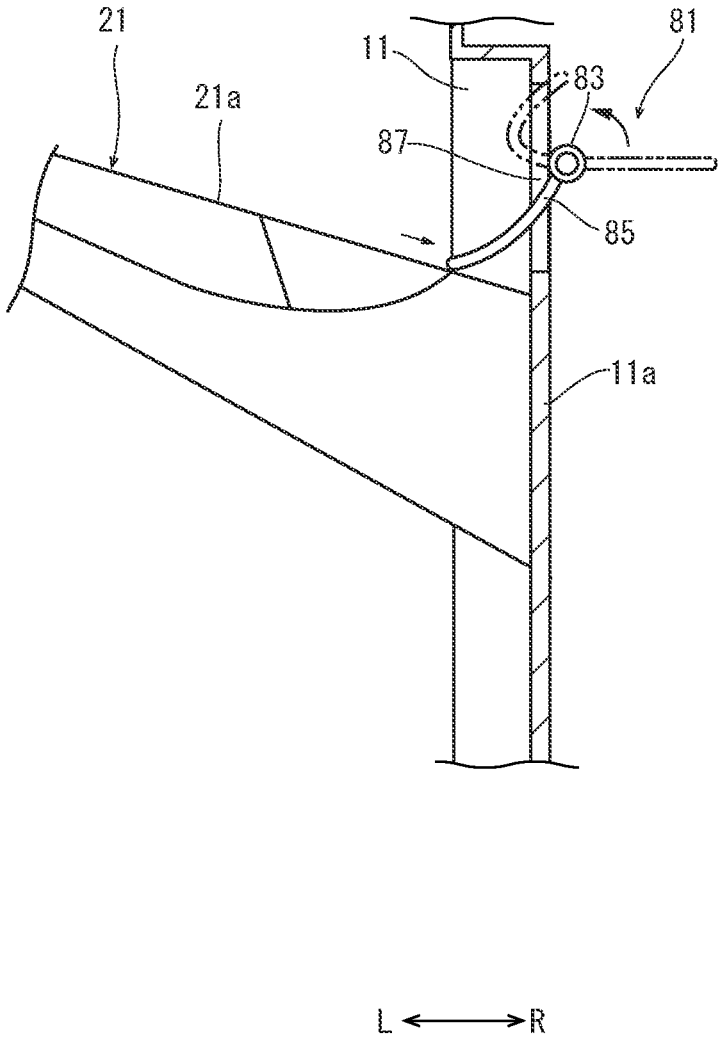
FIG. 6 is a side view showing a return member of the sheet stacking device according to the embodiment of the present disclosure.

In the above embodiment, a return member 81 which returns the sheet stacked on the sheet stacking surface 21*a* to the upstream side in the discharge direction may be provided. The return member 81 will be described with reference to FIG. 6. For convenience of explanation, the alignment belts 25 are not shown in FIG. 6.

The return member 81 has a rotary shaft 83 and a paddle 85 fixed to the rotary shaft 83. The rotary shaft 83 is driven by a motor (not shown) and rotates in the clockwise direction of FIG. 6. The paddle 85 is made of elastic material having a large frictional resistance to the sheet. The return member 81 is disposed inside an opening 87 formed in the upper end portion of the bottom wall 11*a* of the recess 11.

When the rotary shaft 83 is driven by the motor and rotated, the paddle 85 projects outward through the opening 87, rotates while contacting with the sheet stacking surface 21*a* of the discharge tray 21, and again enters the inside through the opening 87. In a state where the sheet or the sheet stack is stacked on the sheet stacking surface 21*a*, when the paddle 85 enters the inside through the opening 87 while contacting with the sheet stacking surface 21*a*, the paddle 85 comes into contact with the sheet or the sheet stack and returns the sheet or the sheet stack toward the side of the opening 87, that is, toward the bottom wall 11*a* of the recess 11, and causes the trail edge of the sheet or the sheet stack to come into contact with the alignment belts 25. Thus, the trail edge of the sheet or the sheet stack is aligned.

In the above embodiment, the guide plate 61 is formed of a single flat plate-shaped member, but may be formed of a plurality of elongated plate-shaped members that are long in the horizontal direction. In this case, since the contact area between the guide plate 61 and the alignment belts 25 can be narrowed, even when the load applied to the alignment belts 25 is increased due to the increased stacking height, the friction between the alignment belts 25 and the guide plate 61 can be reduced when the discharge tray 21 is moved up and down. In order to further reduce the friction, the guide plate 61 may be provided with a plurality of hemispherical projections or rollers which rotate in contact with the alignment belts 25. In this case, it is preferable to arrange them so as not to protrude from the alignment surface as much as possible so as not to affect the alignment surface.

Although the present disclosure has been described with respect to specific embodiments, the present disclosure is not limited to the embodiments described above. Those skilled in the art will be able to modify the above embodiments without departing from the scope and spirit of the present disclosure.

The invention claimed is:

1. A sheet stacking device comprising:

a discharge port through which a sheet is discharged along a predetermined discharge direction;

an alignment wall extending in an upper-and-lower direction below the discharge port;

a discharge tray on which the sheet discharged through the discharge port is stacked and provided so as to be capable of moving up and down along the alignment wall;

an alignment belt stretched along the alignment wall in the upper-and-lower direction so as to be able to circulate in the upper-and-lower direction, the alignment belt having an inner circumferential surface facing the alignment wall and an outer circumferential surface with which an upstream edge of the sheet stacked on the discharge tray in the discharge direction comes into contact, and circulating in the upper-and-lower direction at a same speed as the discharge tray in synchronization with the discharge tray; and a guide part configured to be provided between the alignment wall and the alignment belt, the guide part with which the inner circumferential surface of the alignment belt slides in contact, wherein a sliding sheet having higher slidability than the guide part is attached on a surface of the guide part facing the inner circumferential surface of the alignment belt.

2. The sheet stacking device according to claim 1, further comprising a recess provided below the discharge port, wherein the alignment wall, the alignment belt and the guide part are provided in the recess.

3. The sheet stacking device according to claim 1, wherein the guide part is constituted by a plurality of plate-shaped members elongated in a horizontal direction, disposed at intervals in the upper-and-lower direction.

4. The sheet stacking device according to claim 1, further comprising a return member which returns the sheet stacked on the discharge tray to the upstream side in the discharge direction and brings the trail edge of the sheet into contact with the alignment belt.

5. A post-processing apparatus comprising:

a main body configured to perform predetermined post-processing on a sheet and to discharge the sheet from a discharge port; and the sheet stacking device according to claim 1, in which the sheet discharged from the discharge port is stacked.

6. A sheet stacking device comprising:

a discharge port through which a sheet is discharged along a predetermined discharge direction;

an alignment wall extending in an upper-and-lower direction below the discharge port;

a discharge tray on which the sheet discharged through the discharge port is stacked and provided so as to be capable of moving up and down along the alignment wall;

an alignment belt stretched along the alignment wall in the upper-and-lower direction so as to be able to circulate in the upper-and-lower direction, the alignment belt having an inner circumferential surface facing the alignment wall and an outer circumferential surface with which an upstream edge of the sheet stacked on the discharge tray in the discharge direction comes into contact, and circulating in the upper-and-lower direction at a same speed as the discharge tray in synchronization with the discharge tray;

a guide part configured to be provided between the alignment wall and the alignment belt, the guide part with which the inner circumferential surface of the alignment belt slides in contact; and an elevating part configured to move up and down the discharge tray, wherein the elevating part includes:

a drive shaft and a driven shaft disposed along a width direction perpendicular to the discharge direction and spaced apart from each other in the upper-and-lower direction; and a pair of lifting belts which supports the discharge tray and is stretched between the drive shaft and the driven shaft so as to be able to circulate in the upper-and-lower direction, the alignment belt includes a pair of alignment belts, and the pair of alignment belts is disposed between the pair of lifting belts at a predetermined interval in the width direction, and are stretched between the drive shaft and the driven shaft.

7. A sheet stacking device comprising:

a discharge port through which a sheet is discharged along a predetermined discharge direction;

an alignment wall extending in an upper-and-lower direction below the discharge port;

a discharge tray on which the sheet discharged through the discharge port is stacked and provided so as to be capable of moving up and down along the alignment wall;

an alignment belt stretched along the alignment wall in the upper-and-lower direction so as to be able to circulate in the upper-and-lower direction, the alignment belt having an inner circumferential surface facing the alignment wall and an outer circumferential surface with which an upstream edge of the sheet stacked on the discharge tray in the discharge direction comes into contact, and circulating in the upper-and-lower direction at a same speed as the discharge tray in synchronization with the discharge tray; and a guide part configured to be provided between the alignment wall and the alignment belt, the guide part with which the inner circumferential surface of the alignment belt slides in contact, wherein the alignment belt includes a pair of alignment belts, and the guide part is a flat plate-shaped member having a height equivalent to a lifting range of the discharge tray and a width larger than a distance between the pair of alignment belts.

* * * * *